US006287425B1

(12) United States Patent
Richards

(10) Patent No.: US 6,287,425 B1
(45) Date of Patent: Sep. 11, 2001

(54) APPARATUS FOR INCREASING BULK OF FORESHORTENED FIBROUS WEB

(75) Inventor: Mark R. Richards, Middletown, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/080,863

(22) Filed: May 18, 1998

(51) Int. Cl.[7] ..... B31F 1/12

(52) U.S. Cl. ..... 162/280; 162/109; 162/117; 162/296; 162/309

(58) Field of Search ..... 162/109, 117, 162/187, 265, 266, 280, 296, 309

(56) References Cited

U.S. PATENT DOCUMENTS

| | | | |
|---|---|---|---|
| 3,097,994 | 7/1963 | Dickens et al. . | |
| 3,291,678 | 12/1966 | Enlof et al. . | |
| 3,615,976 | 10/1971 | Endres et al. . | |
| 3,880,705 | 4/1975 | Tilburg | 162/101 |
| 3,925,127 | 12/1975 | Yoshioka . | |
| 4,324,613 * | 4/1982 | Wahren | 162/111 |
| 4,994,144 | 2/1991 | Smith et al. . | |
| 5,623,771 * | 4/1997 | Winheim | 34/585 |
| 5,702,571 | 12/1997 | Kamps et al. . | |

FOREIGN PATENT DOCUMENTS

| | | |
|---|---|---|
| 1220070 | 1/1971 | (GB) . |
| WO 93/11301 | 6/1993 | (WO) . |

* cited by examiner

*Primary Examiner*—Christopher A. Fiorilla
(74) *Attorney, Agent, or Firm*—Vladimir Vitenberg

(57) ABSTRACT

An apparatus for increasing bulk of a foreshortened fibrous web includes a working surface designed to receive a foreshortened web thereon, a means for adding moisture to at least selected portions of the web thereby relaxing the crepe in the selected portions, and a means for retaining the crepe in the rest of the web. A preferred apparatus includes a pair of opposite surfaces, at least one of which having expansion conduits therethrough, the web being impressed between the surfaces. A temperature differential is created between the two opposite surfaces, sufficient to drive the moisture added to the selected portions therethrough, thus relaxing the crepe in the selected portions which expand into the expansion conduits, while the crepe is retained in the rest of the web impressed between the two surfaces.

16 Claims, 3 Drawing Sheets

APPARATUS FOR INCREASING BULK OF FORESHORTENED FIBROUS WEB

FIELD OF THE INVENTION

The present invention is related to processes and apparatuses for making strong, soft, absorbent fibrous webs. More particularly, the present invention is concerned with foreshortened fibrous webs.

BACKGROUND OF THE INVENTION

Fibrous structures, such as paper webs, are produced by a variety of processes. For example, paper webs may be produced according to commonly-assigned U.S. Pat. No. 5,556,509, issued Sept. 17, 1996 to Trokhan et al.; U.S. Pat. No. 5,580,423, issued Dec. 3, 1996 to Ampulski et al.; U.S. Pat. No. 5,609,725,issued Mar. 11, 1997 to Phan; U.S. Pat. No. 5,629,052, issued May 13, 1997 to Trokhan et al.; U.S. Pat. No. 5,637,194, issued Jun. 10, 1997 to Ampulski et al.; and U.S. Pat. No. 5,674,663, issued Oct. 7, 1997 to McFarland et al., the disclosures of which are incorporated herein by reference. Paper webs may also be made using through-air drying processes as described in commonly-assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 4,529,480, issued Jul. 16, 1985 to Trokhan; U.S. Pat. No. 4,637,859, issued Jan. 20, 1987 to Trokhan; and U.S. Pat. No. 5,334,289, issued Aug. 2, 1994 to Trokhan et al. The disclosures of the foregoing patents are incorporated herein by reference.

Foreshortening of a fibrous web may be used to increase the web's caliper, absorbency and softness. Foreshortening refers to reduction in length of a dry web, resulting from application of energy to the web. Typically, during foreshortening, rearrangement of the fibers in the web occurs, accompanied by at least partial disruption of fiber-to-fiber bonds. As a result of foreshortening, micro-folds, commonly called "crepe" are formed in the web.

It has been discovered that the increase in caliper, or bulk, of the foreshortened web may further be achieved by relaxing, at least partially, the crepe in the web. It has been further found that the crepe can be relaxed in pre-selected portions of the web such that the rest of the web, not affected by the crepe relaxation, retains the quality of the foreshortened web.

Accordingly, it is a subject of the present invention to provide a novel process for increasing bulk of the foreshortened web by relaxing the web's crepe in the selected portions of the web. It is another object of the present invention to provide an apparatus for increasing bulk of the foreshortened web by relaxing the web's crepe in the selected portions of the web.

SUMMARY OF THE INVENTION

The present invention provides a process and an apparatus for 25 increasing caliper/bulk of a foreshortened fibrous web by causing selected micro-regions, or portions, of the foreshortened web to relax crepe therein, thereby expanding outwardly from the general plane of the web. The process comprises the steps of providing a foreshortened web comprising crepe and having a general plane; and adding moisture to the web or to at least the web's selected portions, thereby causing relaxation of the crepe in the selected portions and their expansion outwardly from the general plane of the web, while retaining the crepe in the rest of the web. The preferred apparatus comprises two mutually opposite surfaces designed to receive and restrain the foreshortened web therebetween, at least one of the surfaces having a plurality of fluid-permeable expansion conduits therethrough; a means for moistening the web or at least its selected portions corresponding to the expansion conduits when the foreshortened web is disposed between the two surfaces; and a means for creating a temperature differential between the two surfaces such that when the web is restrained between the surfaces, the temperature differential is sufficient to cause the moisture added to the web to move through the web in the direction from one surface toward the other, thereby relaxing crepe in the selected portions of the web and causing the selected portions to expand through the expansion conduits.

A first step of the process of the present invention comprises providing a foreshortened, and preferably fibrous, web. The term "foreshortened" web refers to a web which has been reduced in length, i.e., substantially proportionally contracted along its length, in a machine direction. The first step of providing a fibrous web may be preceded by the steps of forming such a web and then foreshortening the web. The fibrous web suitable for the present invention may be made by any papermaking process known in the art, including, but not limited to, a conventional process and a through-air drying process. The present invention also contemplates the use of the web that has been rewetted prior to being foreshortened. The foreshortened web is generally characterized by a plurality of micro-folds running across the web's length, which is known in the art as "crepe." Foreshortening may be accomplished by any method known in the art, for example, by creping, by transferring the web from the first press surface to a slower-moving transfer fabric, or by the combination thereof.

Preferably, the foreshortened web is disposed on a working surface. The preferred working surface has a plurality of fluid-permeable expansion conduits therethrough. One preferred working surface is formed by a belt comprising a (preferably resinous) framework joined to a fluid-permeable reinforcing structure and protruding outwardly from the reinforcing structure, thereby forming the network area. The framework may comprise an essentially continuous and macroscopically monoplanar network area, in which case the plurality of expansion conduits preferably comprises a plurality of discrete orifices, or holes, which are dispersed throughout and encompassed by the continuous network area of the working surface. Alternatively or additionally, the work surface may comprise a plurality of discrete areas formed by discrete protrusions extending from the reinforcing structure, in which case an essentially continuous expansion conduit encompasses the plurality of discrete protrusions.

Preferably, the expansion conduits and/or protrusions are arranged in a pre-selected pattern, and more preferably, the pattern of the arrangement of the expansion conduits and/or protrusions is non-random and repeating. If the patterned working surface comprises discrete areas formed by the individual protrusions, the work surface's discrete areas may have the discrete expansion conduits therethrough, analogous to the discrete expansion conduits in the continuous work surface. The working surface may comprise a surface of a fluid-permeable platen or—in a preferred continuous process—a fluid-permeable endless belt or band capable of traveling in a machine direction.

The steps of disposing the foreshortened web on the working surface and moistening the web may be performed either sequentially or simultaneously. If the dry foreshortened web is being first disposed on the working surface, the moisture can subsequently be added to the web disposed on the working surface. Various means may be used for moistening the foreshortened web, such as, for example, spraying the web with water or penetrating the web by steam under pressure. A plurality of jets discharging water onto the selected portions of the web according to a pre-determined pattern may also be used. Preferably, the web, or its selected portions, is/are moistened to have a moisture content from about 95% to about 25%, i.e., the web's preferred fiber-consistency is from about 5% to about 75%. More preferably, the moisture content of the selected portions of the web, after they have been moistened, is from 85% to 35%, i.e., the web's more preferred fiber-consistency is from about 15% to about 65%.

The moisture may be added primarily to the selected portions of the foreshortened web, i.e., those portions which correspond to the expansion conduits of the working surface, and which are not in direct and immediate contact with the working surface. The moisture is added to the selected portions of the web preferably after or simultaneously with the step of disposing the web on the working surface. The moisture added to the web may comprise such functional papermaking additives as softeners and debonders, including, but not limited to, lotions, perfumes, anti-microbial agents, wet-strength resin, etc.

Under the influence of the moisture added, the web's selected portions relax the crepe therein and consequently expand outwardly from the general plane of the web, thus increasing bulk of the web. At the same time, the rest of the web, comprising surface-contacting portions which are in direct and immediate contact with the working surface, retains the crepe therein. The resulting web structure comprises, therefore, at least two distinct regions: a region formed by the web's previously foreshortened portion which has retained the crepe therein, and a region comprising the crepe-relaxed portion having increased (relative to the previously foreshortened portion) caliper. Each of the regions may be substantially continuous, or may comprise a plurality of discrete micro-regions, or a combination thereof. Preferably, the crepe-relaxed portion comprises a plurality of discrete domes outwardly extending from the plane formed by the foreshortened portions of the web. The domes may extend from one side of the web, or from both opposite sides of the web.

One way of retaining crepe in the surface-contacting portions of the foreshortened web comprises adhering the surface-contacting portions to the working surface such as to prevent lateral movement of the surface-contacting portions relative to the working surface with which they are in contact. To accomplish this, the working surface can be treated with an adhesive material, such as, for example, creping adhesive. Alternatively or additionally, the working surface can comprise asperities thereon, preventing the lateral movement of the surface-contacting portions. Other means of creating a sufficient friction between the working surface and the surface-contacting portions of the foreshortened web may be employed to prevent the lateral movement of the surface-contacting portions relative to the working surface.

In the preferred embodiment of the process and the apparatus, a pressing surface, opposite to and facing the working surface, is provided. The pressing surface is a surface adapted to impress the foreshortened web against the working surface. The foreshortened web is constrained, or impressed, between the working and pressing surfaces to the extent necessary to prevent (or contain if desired) expansion of those portions of the web which do not correspond to the expansion conduits. Those portions (defined herein as "surface-contacting portions") retain the crepe therein, while the selected portions of the web are free to expand through the expansion conduits.

The pressing surface may comprise an essentially flat area, or it may have projected areas. The projected areas may comprise continuous network area, or discrete areas, or a combination thereof. Pressing surface may also have expansion conduits therethrough, similar to those of the working surface. The expansion conduits of the pressing surface can correspond to the expansion conduits of the working surface. In the latter instance, the moisture (water and/or steam) can be delivered to and removed from the web using corresponding expansion conduits of the pressing and working surfaces. The latter embodiment provides an additional benefit of allowing the selected portions expand in both opposite directions—through the expansion conduits of the working surface and through the expansion conduits of the pressing surface. In another embodiment, the pressing surface's conduits do not correspond to the working surface's conduits. In this instance some of the selected portions of the web can expand only through the pressing surface's conduits, while the other selected portions can expand only through the working surface's conduits. The last two embodiments of the process and the apparatus allow one to create structured patterned webs.

Preferably, the working surface is associated with a supporting surface such that the working surface having the web thereon is juxtaposed between the pressing surface (contacting the web) and the supporting surface. In the preferred embodiment of the apparatus and the process of the present invention, a temperature differential of at least 50° F. is created between the pressing surface and the supporting surface. Preferably, but not necessarily, the pressing surface has a relatively higher temperature, and the supporting surface has a relatively lower temperature. The preferred temperature differential is at least 50° F., and the more preferred temperature differential is at least 100° F. A preferred temperature of the "cold" surface is less than 212° F. The temperature differential drives the moisture added to the web through the web's selected portions thereby relaxing the crepe in the selected portions and causing the selected portions to expand through the expansion conduits. To accumulate the moisture driven through the web, a fluid-permeable fabric is juxtaposed between the "cold" (preferably working) surface and the "hot" (preferably supporting) surface. The fabric should have a void volume sufficient to accumulate the moisture condensing thereinto. This process or any other process known in the art may be used to dry the web.

In one preferred embodiment, the pressing surface comprises a surface of a sintered layer capable of retaining sufficient volume of moisture. The preferred sintered layer comprises metal woven belt capable of containing a sufficient volume of moisture therein and to release the moisture under the influence of the temperature differential. The metal is preferred for its superior heat-transfer properties. When the web and the working surface are impressed between the pressing and supporting surfaces, the moisture contained in the sintered layer moves into and through the web and towards the supporting surface. The crepe in the surface-contacting portions of the web, which are sufficiently contained between the pressing surface and the working surface, is not affected (or affected to a lower degree, if desired) by the water driven through the web from the pressing surface towards the supporting surface. The web's selected areas, which correspond to the expansion conduits of the working surface and/or the pressing surface, are not sufficiently contained between the pressing surface and the working surface, due to the existence of the expansion conduits in both or one of the surfaces. Therefore, the selected portions are not prevented from expanding through the expansion conduits (or prevented to a significantly lower degree relative to the surface-contacting portions). The expanded selected portions of the web form "domes" of a finished product, thereby increasing the bulk or overall caliper of the finished web.

In one of the embodiments of the preferred continuous process of the present invention, each of the pressing surface and the working surface is formed by an endless belt or band traveling in the machine direction. An endless condensation belt (fabric) traveling in the machine direction and capable of receiving a sufficient amount of the condensed moisture is disposed between the supporting surface and the working surface. The moisture which is driven through the selected portions of the web and through the expansion conduits of the working surface condenses into the fabric disposed between the working surface and the supporting surface. A means for collecting and recycling the moisture, well known in the art, may be used in the process of the present invention.

The portions which are impressed between the working surface and the pressing surface may be further densified, if desired. The selected portions of the web corresponding to the expansion conduits are not densified, or densified (if desired) to a lesser degree than the impressed portions are. In the latter instance, a pressure differential may be controlled, on the one hand—by the distance between the pressing surface and the corresponding working surface, and on the other hand—by the distance between the pressing surface and a surface restricting the expansion of the selected portions.

In the pressing surface comprising projected areas, some of the projected areas may be registered (either in a knob-to-knob pattern, or in a nested pattern, or in a pattern comprising a combination thereof) with the working surface when the web is impressed between the pressing surface and the working surface. The embodiment of the apparatus is contemplated, in which only some of the projected areas of the pressing surface have corresponding projected areas of the working surface. Thus, some of the selected portions of the web may be partially restrained, in the direction perpendicular to the working surface, to a lesser degree relative to the portions impressed between the working surface and the pressing surface. Consequently, it is believed that the selected portions of the web may comprise in the latter instance sub-portions which are relatively unconstrained in the direction perpendicular to the working surface, and sub-portions which are relatively constrained and may be partially impressed (and therefore possibly densified) by the pressing surface's projected areas corresponding to the expansion conduits of the working surface. Such an arrangement of the working surface and the pressing surface may beneficially produce a web having at least three differential micro-regions: first micro-regions formed by the portions constrained in the direction perpendicular to the working surface and thus substantially retaining the crepe therein; second micro-regions formed by the sub-portions partially-constrained in the direction perpendicular to the working surface and thus having crepe partially relaxed, the second micro-regions partially expanding in the direction perpendicular to the working surface; and the third micro-regions formed by the sub-portions relatively unconstrained in the direction perpendicular to the working surface, having crepe substantially relaxed therein, the third micro-regions expending in the direction perpendicular to the working surface.

The expansion of the selected areas may be assisted by deflecting, under pressure, the moistened selected portions of the web through the expansion conduits. Vacuum or differential pressure can be used as a means for deflecting the selected portions through the expansion conduits. The means for deflecting may also comprise steam or water moving, preferably under pressure, through the selected portions and through the expansion conduits. A combination of steam and water as means for deflecting is also contemplated in the present invention. The pressing surface's projected areas corresponding to the expansion conduits of the working surface can also comprise the means for deflecting the selected portions of the web. In one exemplary embodiment, the projected areas of the pressing surface correspond to the expansion conduits of the working surface and are in contact with the selected portions of the web. When the web is constrained between the pressing surface and the working surface, the projected areas of the pressing surface push the selected portions of the web through the expansion conduits of the working surface, thereby facilitating the expansion of the selected portions.

"Angled" expansion of the selected portions is also contemplated by the present invention. In this instance, the selected portions of the web are caused to expand to form an "angled" position relative to the plane of the belt, i.e., the axes of at least some of the domes formed by the selected portions and the working surface form acute angles therebetween. The working surface may comprise a plurality of protuberances, at least some of which are angled relative to the working surface, i.e., the axes of the protuberances and the working surface form acute angles therebetween. Than, the selected portions of the web, while expanding through the expansion conduits, will take the "angled" position relative to the working surface, and the final web product will have the "angled" continuous domes, i.e., the continuous domes cross-sectional axes of which form acute angles with the general plan of the web.

The web having the crepe relaxed in the selected portions may be re-foreshortened by, for example, adhering the crepe-relaxed and expanded selected portions of the web to the creping surface and then creping therefrom with a doctor blade.

DETAILED DESCRIPTION OF THE INVENTION

Figure 1:
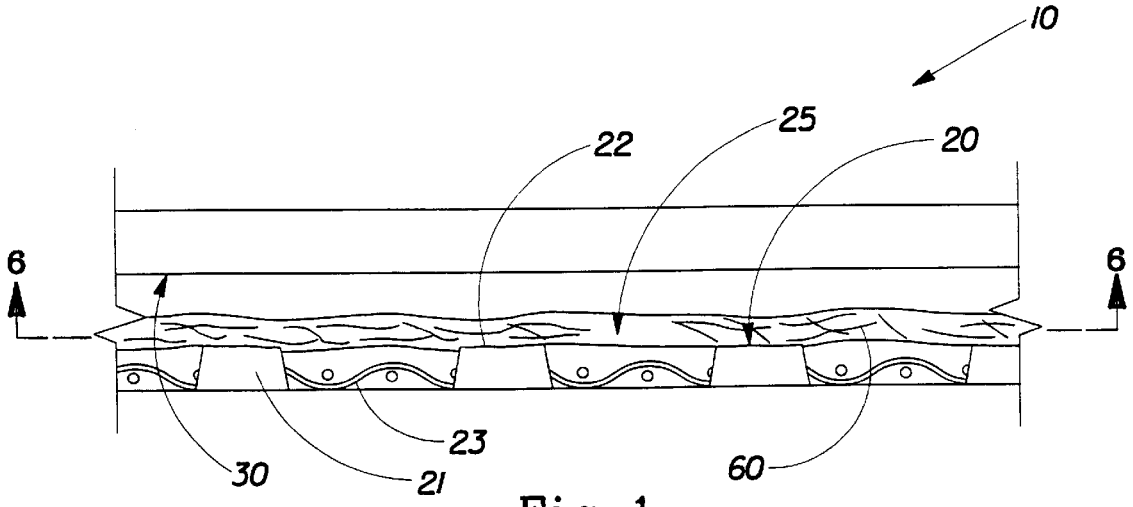
FIG. 1 is a schematic and simplified side elevational view of the apparatus of the present invention, showing a web disposed on a working surface.

The present invention provides a process and an apparatus for increasing bulk of a foreshortened web by causing selected portions of the foreshortened web to relax crepe, thereby expanding outwardly from one or both opposite sides of the web.

A first step of the process of the present invention comprises providing a foreshortened, and preferably fibrous, web. As used herein the term "fibrous web" or simply "web" designates a macroscopically planar substrate comprising cellulosic fibers, synthetic fibers, or any combination thereof. The first step of providing a web 60 may be preceded by the steps of forming such a web and then foreshortening the web. One skilled in the art will readily recognize that forming the web 60 may include the steps of providing a plurality of papermaking fibers. Suitable fibers comprising the web 60 may include recycled, or secondary, papermaking fibers, as well as virgin papermaking fibers. Such fibers may comprise hardwood fibers, softwood fibers, and non-wood fibers.

In a typical continuous papermaking process, the plurality of fibers are preferably suspended in a liquid carrier. More preferably, the plurality of fibers comprises an aqueous dispersion. An equipment for preparing the aqueous dispersion of fibers is well-known in the art and is therefore not illustrated herein. The aqueous dispersion of fibers may be provided to a headbox or headboxes. The headbox(es) and the equipment for preparing the aqueous dispersion of fibers are typically of the type disclosed in U.S. Pat. No. 3,994,771, issued to Morgan and Rich on Nov. 30, 1976, which patent is incorporated by reference herein. The preparation of the aqueous dispersion of the papermaking fibers and exemplary characteristics of such an aqueous dispersion are described in greater detail in U.S. Pat. No. 4,529,480, which patent is incorporated by reference herein. The fibrous web suitable for the present invention may be made by any papermaking process known in the art, including, but not limited to, a conventional process and a through-air drying process. The present invention also contemplates the use of the web 60 that has been rewetted. Rewetting of a previously-manufactured dry web may be used for creating three-dimensional web structures by, for example, embossing the rewetted web and than drying the embossed web.

As used herein, the term "foreshortened" web refers to a web which has been substantially proportionally contracted along its length, i.e., in a machine direction. In the papermaking, the machine direction, or MD, indicates that direction which is parallel to and has the same direction as the flow of the web through a papermaking equipment. The cross-machine direction, or CD, is perpendicular to the machine direction and parallel to the general plane of the web.

The foreshortened web is generally characterized by a plurality of micro-folds running across the web's length. Such micro-folds are typically known in the art as "crepe." Foreshortening may be accomplished by any method known in the art, for example, by creping, by transferring the web from the first press surface to a slower moving transfer fabric, or by the combination thereof. As used herein, the web which has been foreshortened has crepe therein, regardless of the method of foreshortening.

Creping is usually performed with a creping doctor blade juxtaposed with the creping surface having the web adhered thereto. Creping may be accomplished according to commonly assigned U.S. Pat. No. 4,919,756, issued on Apr. 24, 1992 to Sawdai, the disclosure of which is incorporated herein by reference. A conventional creping blade is positioned against the creping surface so as to create an impact angle between the blade and the creping surface, wherein the impact angle ranges from about 70 degrees to about 90 degrees. A creping adhesive may be applied directly to the creping surface. Creping adhesives comprising polyvinyl alcohol, animal-based protein glues, or mixtures thereof, well known in the art, may be utilized. The commonly-assigned U.S. Pat. No. 3,926,716 issued to Bates on Dec. 16, 1975, and incorporated herein by reference, teaches a polyvinyl alcohol creping adhesive. The U.S. Pat. No. 4,501,640 issued to Soerens on Feb. 26, 1985; U.S. Pat. No. 5,187,219 issued to Furman, Jr. on Feb. 16, 1993; U.S. Pat. No. 5,494,554 issued to Edwards et al. on Feb. 27,1996 describe various types of creping adhesives. Optionally, various plasticizers may be used in conjunction with the creping adhesive. For example, the plasticizer commercially sold as CREPETROL R 6390 is available from Hercules Incorporated of Wilmington, Del.

Foreshortening comprises a process commonly described as a "microcontraction." Microcontraction includes transferring the web from one moving surface (typically a foraminous member or a papermaking belt) to another, a slower-moving surface (typically a transfer belt). U.S. Pat. No. 4,440,597, commonly assigned and incorporated by reference herein, describes in detail a "wet-microcontraction." Briefly, wet-microcontraction involves transferring the web having a low fiber-consistency from a first member (such as a foraminous member) to a second member (such as a loop of open-weave fabric) moving slower than the first member. According to U.S. Pat. No. 4,440,597, the preferred consistency of the web prior to the transfer is from about 10% to about 30% fibers by weight, and the most preferred consistency is from about 10% to about 15%. Commonly-assigned patent application entitled "Process and Apparatus For Making Foreshortened Cellulosic Structure,"filed in the names of Carol A. McLaughlin et al. on Dec. 19, 1997 (P&G Case #6966), is incorporated by reference herein.

The next step in the process of the present invention may comprise providing a working surface 20 designed to receive the foreshortened fibrous web 60. FIGS. 1–7 show various embodiments of the working surface 20. Regardless of the embodiment, the preferred working surface 20 has a plurality of fluid-permeable micro-regions, or expansion conduits, 25 therethrough. As used herein, the term "fluid-pervious" refers to the capability of the expansion conduits 25 to have a fluid, such as liquid (water) or gas (air or steam), transmitted through the conduits 25 without significant obstruction. The conduits 25 are termed "expansion conduits" because they provide void areas through which selected portions of the web can expand outwardly, as will be explained in greater detail below. The preferred expansion conduits 25 comprise unobstructed orifices, or holes, through the working surface 20. Preferably, the expansion conduits 25 are arranged in a pre-selected pattern, and more preferably, the pattern of their arrangement is non-random and repeating throughout the working surface.

Figure 2:
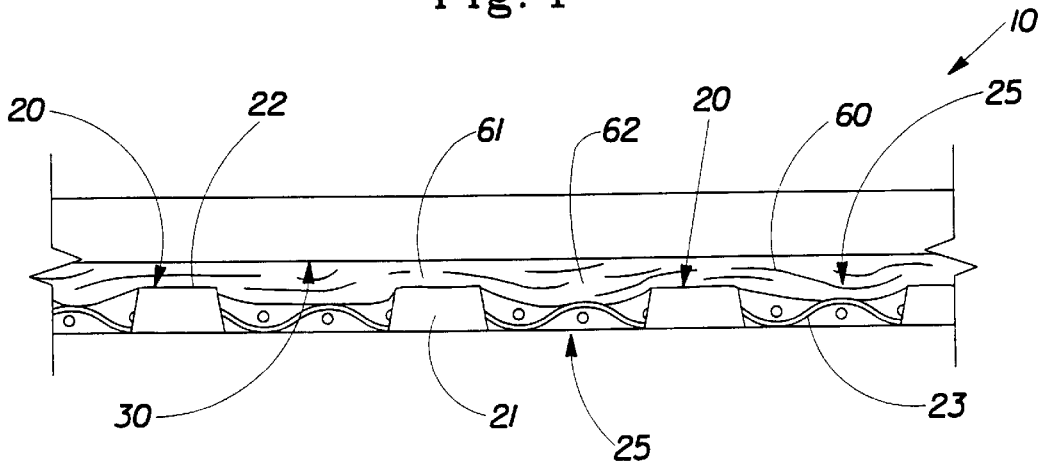
FIG. 2 is a view similar to one shown in FIG. 1, and showing the web being impressed between the working surface and a pressing surface.
Figure 3:
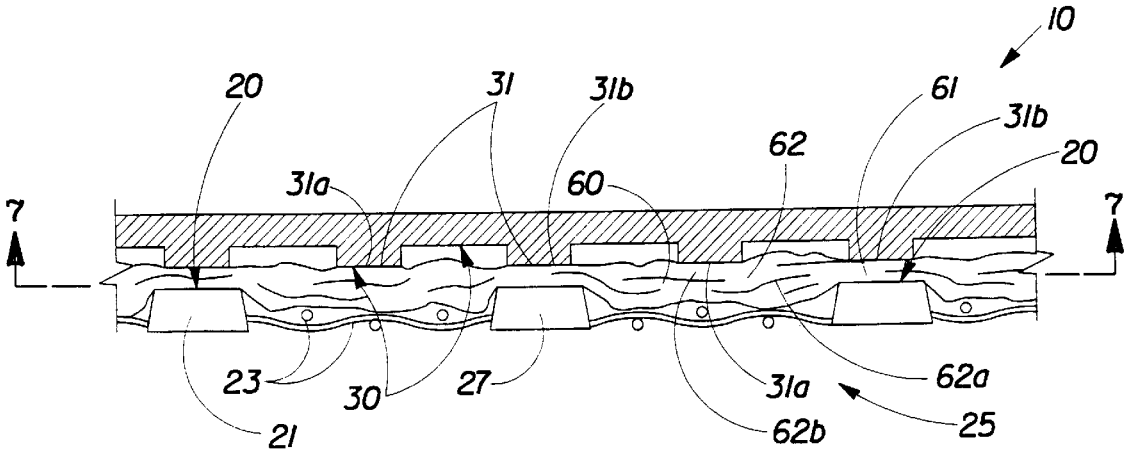
FIG. 3 is a schematic and simplified side elevational view of another embodiment of the apparatus of the present invention, having a pressing surface comprising extending projected areas.
Figure 6:
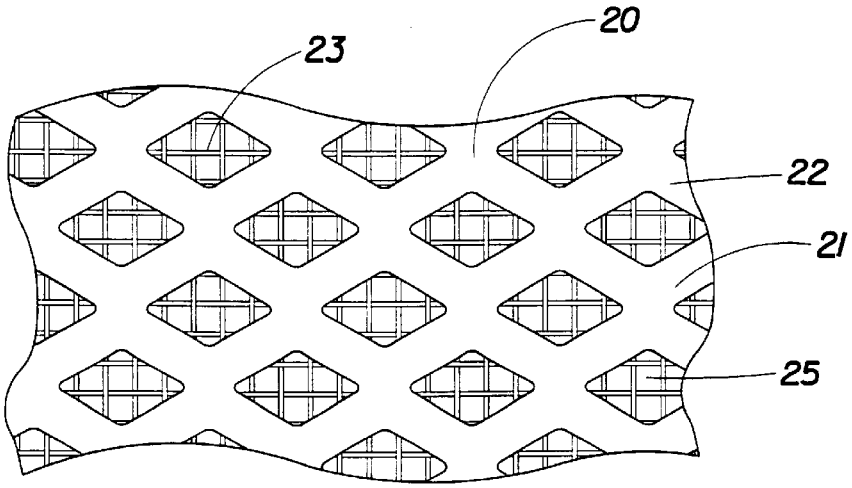
FIG. 6 is a schematic plan view of one embodiment of the working surface comprising a plurality of discrete conduits, taken along lines 6—6 of FIG. 1.

One preferred working surface 20 is formed by a belt comprising a framework 21 joined to a reinforcing structure 23, as shown in FIGS. 1–3. Preferably, the framework 21 is resinous. The framework 21 protrudes outwardly from the reinforcing structure 23, thereby forming the network area 22, as best shown in FIGS. 1 and 6. This type of belt is described in several commonly-assigned U.S. Patents incorporated by reference herein and referred to above. In the embodiment shown in FIGS. 1, 6, and 2, the network 22 is essentially continuous and macroscopically monoplanar, and the plurality of fluid-permeable conduits 25 comprises a plurality of discrete orifices, or holes, which are dispersed throughout and encompassed by the essentially continuous network 22. As used herein, the term "essentially continuous" indicates that interruptions in absolute geometrical continuity, while are not preferred, may be tolerable—as long as these interruptions do not adversely affect the performance of the framework 21 and network 22. It should also be carefully noted that embodiments (not shown) are possible in which interruptions in the absolute continuity of the framework 21 (and thus network 22) are intended as part of the overall design of the working surface 20.

Preferably, the conduits 25 are arranged in a pre-selected pattern throughout the network 22, and more preferably, the pattern of the arrangement of the conduits 25 is non-random and repeating, such as, for example, a continuously-reticulated pattern, best shown in FIG. 6. The belt having a continuous network 22 and discrete fluid-permeable expansion conduits 25 is primarily disclosed in the commonly assigned and incorporated by reference herein U.S. Pat. No. 4,528,239 issued Jul. 9, 1985 to Trokhan; U.S. Pat. No. 4,529,480 issued Jul. 16, 1985 to Trokhan; U.S. Pat. No. 4,637,859 issued Jan. 20, 1987 to Trokhan; U.S. Pat. No. 5,098,522 issued Mar. 24, 1992 to Trokhan et al.; U.S. Pat. No. 5,275,700 issued Jan. 4, 1994 to Trokhan; U.S. Pat. No. 5,334,289 issued Aug. 2, 1994 to Trokhan; and U.S. Pat. No. 5,364,504 issued Nov. 15, 1985 to Smurkoski et al.

Figure 7:
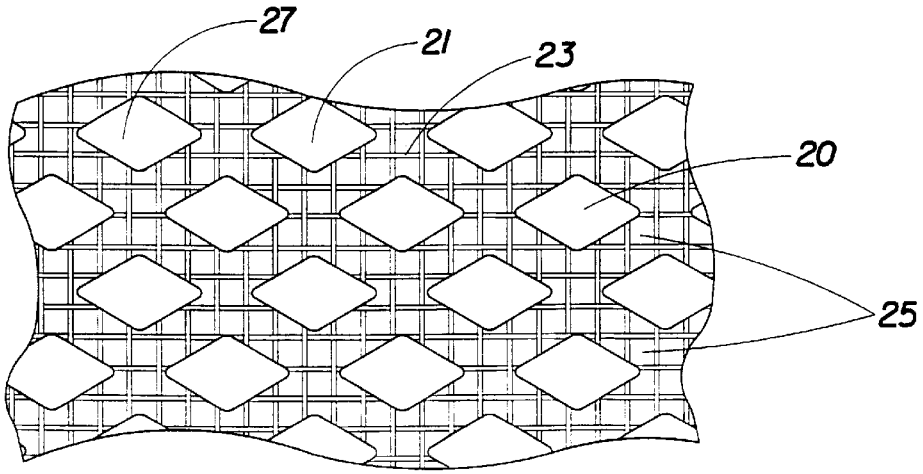
FIG. 7 is a schematic plan view of another embodiment of the working surface comprising a continuous conduit, taken along lines 7—7 of FIG. 3.

The patterned working surface 20 may comprise discrete areas, alternatively or in addition to the continuous network 22. FIGS. 3 and 7 show the working surface 20 comprising a plurality of discrete areas formed by discrete protrusions 27 outwardly extending from the reinforcing structure 23 and separated from one another by an area of essentially continuous expansion conduits 25. The discrete areas formed by the individual protrusions may have the discrete expansion conduits therethrough, similar to the discrete expansion conduits described above in the context of the continuous working area. The belt having the framework 21 comprising the discrete protrusions is primarily disclosed in the commonly assigned and incorporated by reference herein U.S. Pat. No. 4,245,025 issued Sep. 14, 1993 to Trokhan et al. and U.S. Pat. No. 5,527,428 issued Jun. 18, 1996 to Trokhan et al. Also, the papermaking belt having the discrete protuberances raised above the plane of the fabric may be made according to the European Patent Application 95105513.6, Publication No. 0 677 612 A2, filed Dec. 4 1995, inventor Wendt et al.

Figure 4:
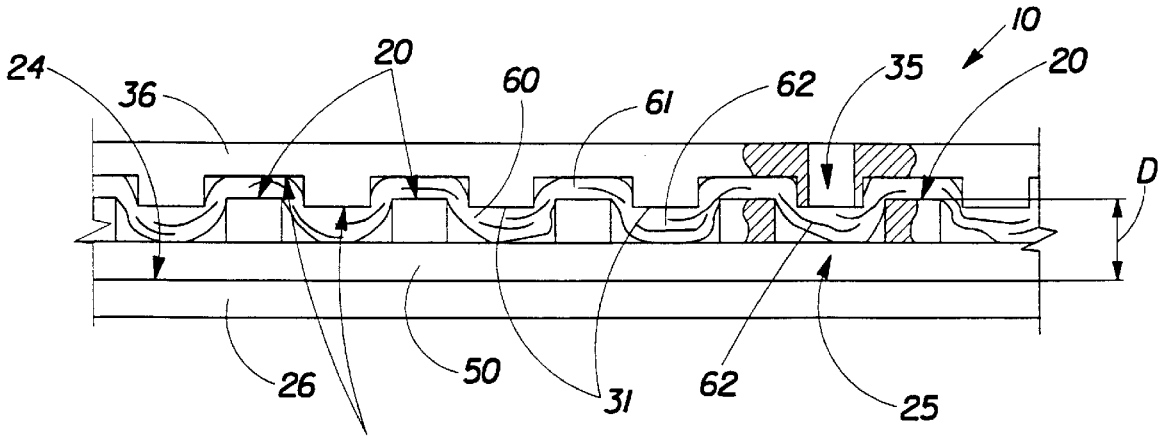
FIG. 4 is a schematic and simplified side elevational view of still another embodiment of the apparatus of the present invention, having a pressing surface comprising extending projected areas and expansion conduits.
Figure 5:
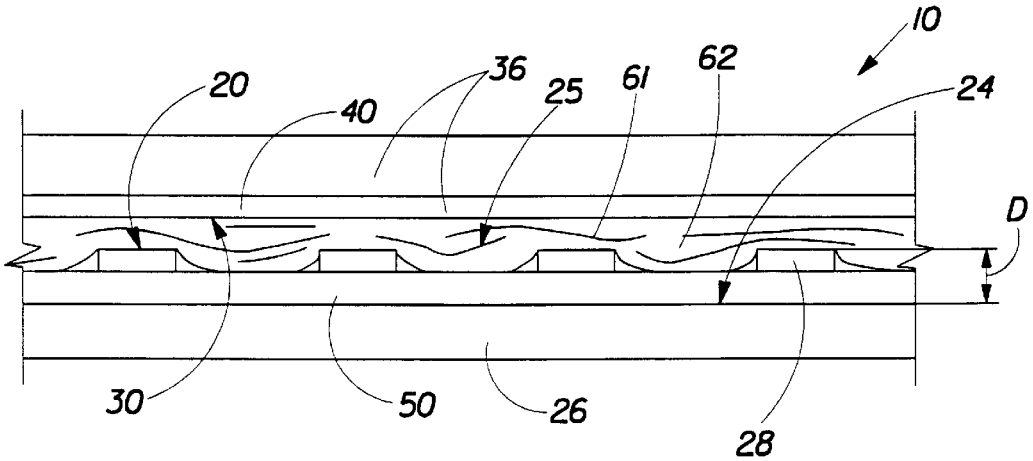
FIG. 5 is a schematic and simplified side elevational view of another embodiment of the apparatus of the present invention, showing the pressing surface comprising a sintered layer.

The working surface 20 may comprise a fluid-permeable platen, or—in a preferred continuous process—a fluid-permeable endless belt or band 28, as schematically shown in FIG. 5. The endless belt or band 28 is designed to continuously travel in the machine direction. Fluid-permeability of the band 28 may be achieved by perforating (preferably, according to a pre-determined pattern) the band 28 throughout its thickness or by other conventional means—to provide expansion conduits 25. Preferably, the band 28 is juxtaposed with a fluid-permeable fabric 50 (FIGS. 4 and 5). The fabric 50 should preferably have a sufficient amount of void volume to be able to receive moisture driven into the fabric 50 from the web 60, as will be explained in greater detail below. The fabric 50 can be woven or non-woven. One preferred fabric comprises Spiral Weave, Duraflex Belt made by Albany International, Engineered Fabrics of Portland, Tenn.

The next two steps in the process of the present invention comprise disposing the foreshortened web 60 on the working surface 20 and moistening the web 60. These steps may be performed sequentially or simultaneously. If the dry foreshortened web 60 is being first disposed on the working surface 20, the moisture can subsequently be added to the web 60 associated with the working surface 20. If the foreshortened web 60 is being first moistened and then disposed on the working surface 20, wet transfer may be used in the process of the present invention for the step of depositing the web 60 on the working surface 20. As one skilled in the art will recognize, wet transfer comprises transferring the wet web from one carrier (a foraminous member or a belt) to another carrier using vacuum or differential pressure.

Various means may be used for moistening the foreshortened web 60. For example, the foreshortened web 60 can be sprayed with water or moistened by steam. Preferably, the web 60 is moistened to have a moisture content from about 95% to about 25%. More preferably, the moisture content of the web 60, after it has been moistened, is from about 80% to about 40%.

According to the present invention, the entire web 60 can be moistened to have the necessary moisture content. Alternatively, moisture may be added primarily to selected portions 62 of the web 60. As used herein, the "selected portions" 62 of the web 60 are those portions which correspond to the expansion conduits 25 of the working surface 20 when the web is disposed on the working surface 20. Preferably, the selected portions 62 are not in direct and immediate contact with the working surface 20, due to the existence of the expansion conduits 25. In the instance when the moisture is added primarily to the selected portions 62 of the web 60, it is preferred that the step of moistening the foreshortened web 60 be performed after or simultaneously with the step of disposing the web 60 on the working surface 20.

The moisture added to the web 60 may comprise various functional papermaking additives, such as softeners and debonders. Examples include, but are not limited to: non-ionic surfactant described in U.S. Pat. No. 5,527,560, issued Jun. 18, 1996 to Fereshtehkhou et al.; a softening composition comprising quaternary ammonium compound, polysiloxane compound, and binder materials described in commonly-assigned U.S. Pat. No. 5,573,753, issued Nov. 12, 1996 to Ampulski et al.; a water-soluble polyhydroxy compound described in commonly-assigned U.S. Pat. No. 5,624,532, issued Apr. 29, 1997 to Phan et al.; a debonder described in Canadian Pat. No. 2,118,529, issued Feb. 2, 1996 to Edwards et al.; softening agent described in U.S. Pat. No. 5,716,498, issued Feb. 10, 1998 to Jenny et al.; a cationic nitrogenous softener/debonder described in U.S. Pat. No. 5,695,607, issued Dec. 9, 1997 to Awofeso et al.; softeners/debonders described in U.S. Pat. No. 5,552,020, issued Sep. 3, 1996 to Schroeder et al.; a cationic silicone described in U.S. Pat. No. 5,591,306, issued Jan. 7, 1997 to Kaun et al.; and others. Other functional additives, such as lotions, emulsions, perfumes, anti-microbial and anti-bacterial agents, and wet-strength resin may also be included into the moisture.

According to the present invention, the moisture added to the web 60 or to the web's selected portions 62 relaxes the crepe in the selected portions 62. Consequently, the selected portions 62 expand outwardly from the general plane of the web 60, thus increasing bulk of the web 60. Preferably, the selected portions 62 expand through the expansion conduits 25 of the working surface 20. At the same time, in accordance with the present invention, the rest of the web 60 retains the crepe therein. As used herein, the rest of the web which retains the crepe is defined as comprising "surface-contacting portions" 61 of the web 60, for the surface-contacting portions 61 are in direct and immediate contact with the working surface 20, in contrast with the selected portions 62 corresponding to the expansion conduits 25.

In the embodiment in which the moisture is added only to the web's selected portion 62, the surface-contacting portions 61 retain the crepe primarily by virtue of not being moistened. Additionally, the working surface 20 may be treated to enhance friction between the working surface 20 and the surface-contacting portions 61, which friction should preferably be sufficient to prevent the surface-contacting portions 61 from laterally moving relative to the working surface 20. The friction between the working surface 20 and the surface-contacting portions 61 may be enhanced by, for example, providing the working surface 20 with asperities thereon, designed to mechanically engage the surface-contacting portions 61 such as to prevent or restrict their lateral movement. Alternatively or additionally, the working surface can be treated with a suitable adhesive, to temporarily adhere the surface-contacting portions 61 to the working surface 20. Neither the asperities nor the adhesive treatment are illustrated in the drawings, for one skilled in the art will easily visualize both embodiments. Other means of creating a sufficient friction between the working surface 20 and the surface-contacting portions 61 of the web 60 may be employed in the apparatus of the present invention to prevent the lateral movement of the surface-contacting portions 61 relative to the working surface 20.

Figure 5A:
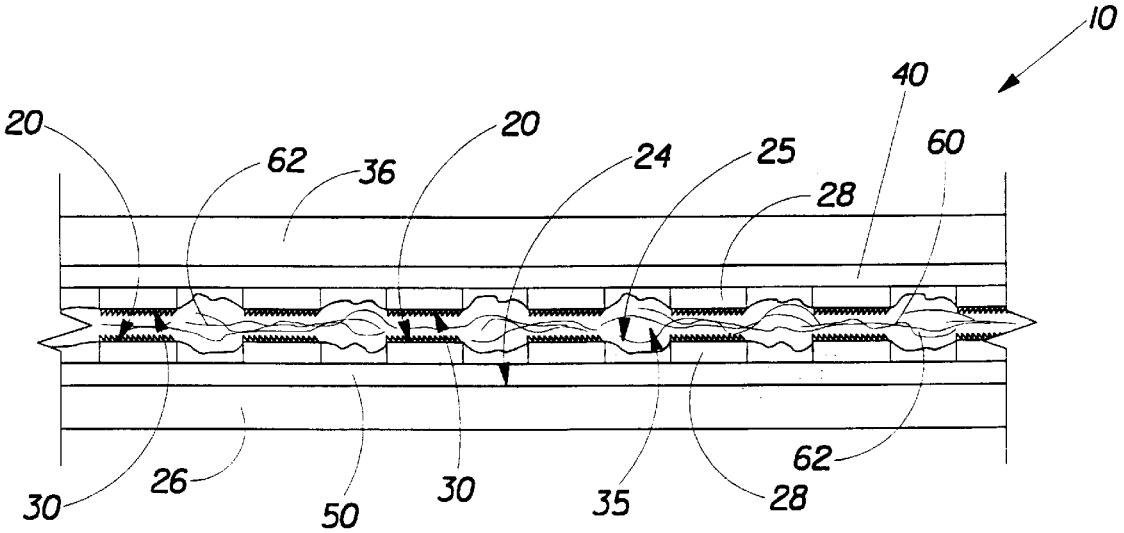
FIG. 5A is a schematic and simplified side elevational view of still another embodiment of the apparatus comprising two mutually opposite surfaces having corresponding expansion conduits therethrough.
Figure 8:
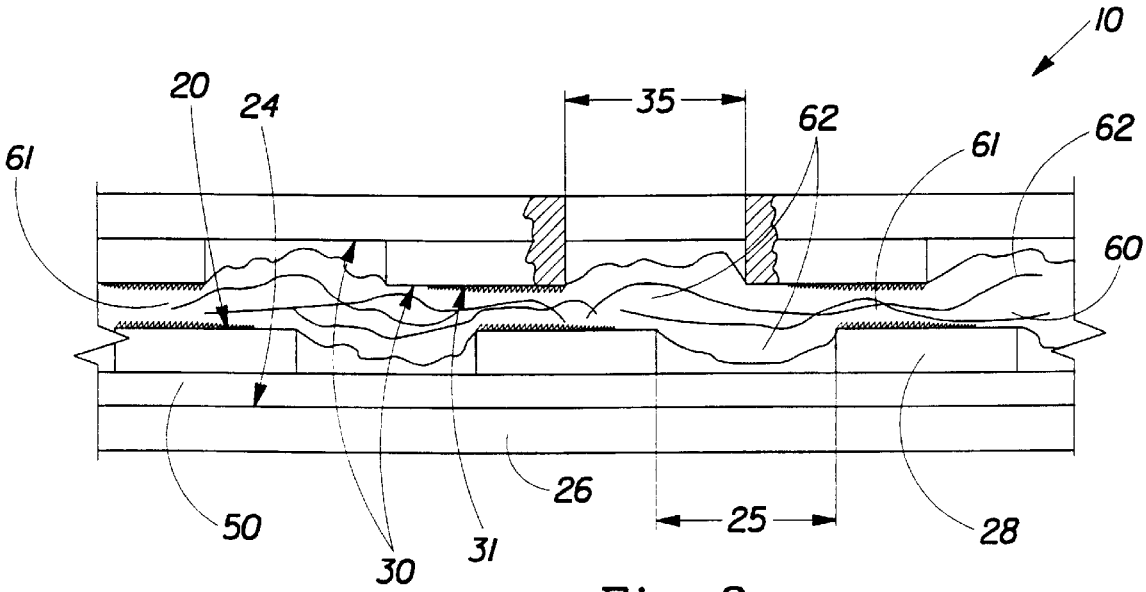
FIG. 8 is a schematic and simplified side elevational view of another embodiment of the apparatus of the present invention, showing both the pressing surface and the working surface having the expansion conduits therethrough, the expansion conduits of the working surface partially corresponding to the expansion conduits of the pressing surface.

After the crepe has relaxed in the selected portions 62 under the influence of moisture, while the rest of the web 60 retains the crepe, the web 60 comprises at least two distinct regions: a region formed by the web's previously foreshortened portion which has retained the crepe therein (i.e., comprising the surface-contacting portions 61), and a region formed by the crepe-relaxed portions (i.e., comprising the selected portions 62) extending outwardly from the general plane of the web 60 and thereby preferably having increased caliper, relative to the surface-contacting portions 61. Each of the regions may be substantially continuous, or comprising a plurality of discrete micro-regions, or a combination thereof, depending on the design of the working surface 20, as has been discussed above. Preferably, in the final product the crepe-relaxed selected portions 62 comprise a plurality of discrete domes outwardly extending from the plane formed by the foreshortened portions of the web 60. The domes may extend from one side of the web 20 (FIGS. 2–5), or from both opposite sides of the web 20 (FIGS. 5A and 8).

Optionally, the moistened selected portions 62 of the web 60 may be subjected to deflection into the expansion conduits 25 of the working surface 20 to facilitate expansion of the selected portions 62 of the web 60 through the expansion conduits 25 of the working surface 20. A variety of deflecting means may be used in the process and the apparatus 10 of the present invention. One skilled in the art will recognize that vacuum pressure or pressure differential may be used as deflecting means. The deflecting means may also comprise steam or water moving, preferably under pressure, through the selected portions 62 and through the expansion conduits 25 of the working surface 20. A combination of steam and water as deflecting means is also contemplated by the present invention.

One preferred embodiment of the apparatus 10 comprises a pressing surface 30. The pressing surface 30 is a surface designed to constrain, or impress, the web 60 against the working surface 20. The pressing surface 30 is opposite to the working surface 20 and preferably substantially parallel to the working surface 20. Although the drawings show the pressing surface 30 and the working surface 20 as substantially planar surfaces, it should be appreciated that both the pressing and working surfaces 30, 20 can be curved, or have other non-planar configuration, as long as they are capable of receiving and constraining the web 60 therebetween.

FIGS. 1–8 show several exemplary embodiments of the pressing surface 30. In FIGS. 1 and 2, the pressing surface 30 comprises an essentially flat and unpatterned area. In FIGS. 3 and 4, the pressing surface 30 comprises projected areas 31, preferably having a pre-determined pattern. The projected areas 31 may comprise a substantially continuous or—alternatively—discrete area, as has been explained above in the context of the network 22 of the working surface 20. The combination of continuous areas and discrete areas of the pressing surface 30 is also contemplated in the present invention. FIGS. 3 and 4 show that at least some of the projected areas 31 of the pressing surface correspond to the expansion conduits 25 of the working surface 20. In these two embodiments, the deflecting means comprises the projected areas 31 of the pressing surface 30, corresponding to the expansion conduits 25 of the working surface 20. The projected areas 31 facilitate the expansion of the selected portions 62 through the conduits 25.

As shown in FIGS. 4 and 8, the pressing surface 30, whether flat or having the projected areas 31, may comprise expansion conduits 35, similar to those of the working surface 20. FIG. 4 shows the expansion conduits 35 which correspond to the projected areas 31, and FIG. 8 shows the conduits 35 which do not correspond to the projected areas 31. In both instances, however, when the web 60 is constrained between the pressing surface 30 and the working surface 20, at least some of the expansion conduits 35 of the pressing surface 30 correspond to the expansion conduits 25 of the working surface 20, as shown in FIGS. 4 and 8. Of course an embodiment is possible in which none of the expansion conduits 35 of the pressing surface 30 correspond to the expansion conduits 25 of the working surface 20 (not shown).

FIG. 5 shows an embodiment of the pressing surface 30 comprising a surface of a sintered layer 40 capable of retaining sufficient volume of moisture. The sintered layer 40 is one preferred means for moistening the web 60. The sintered layer 40 can be made from any suitable material. One preferred material for the sintered layer 40 is sintered stainless steel having pores of about 40 micro-meter ($\mu$m) in diameter, made by Mott Corporation, 84 Spring Lane Farmington, Conn. 06032-3159. Preferably, the sintered layer 40 is capable of retaining a moisture therein in the amount sufficient to moisten the web 60 to the required consistency/moisture content as defined herein.

The apparatus 10 of the present invention preferably further comprises a supporting surface 24. The supporting surface 24, shown in FIGS. 4, 5, and 8 is a surface designed such that the working surface 20 is capable of being interposed between the supporting surface 24 and the pressing surface 30, the working surface 20 facing the pressing surface 30. Preferably, the supporting surface 24 does not directly contact the working surface 20. That is, as shown in FIGS. 4 and 5, there is a distance D between the working surface 20 and the supporting surface 24. Preferably, the supporting surface 24 is associated with the working surface 20 through the fabric 50, as shown in FIGS. 4 and 5. In the embodiment of the apparatus 10 and the process of the present invention, comprising the supporting surface 24, the process step of constraining the foreshortened web 60 between the working surface 20 and the pressing surface 30 comprises impressing the working surface 20 with the associated web 60 thereon between the pressing surface 30 and the supporting surface 24.

In one preferred embodiment of the process of the present invention, schematically illustrated in FIG. 5, the dry foreshortened web 60 is first disposed on the working surface 20 by any conventional means. Then, the foreshortened web 60 disposed on the working surface 20 is contacted by the working surface 20 such that the web 60 is constrained between the pressing surface 30 and the pressing surface 30 comprising the sintered layer 40. When the web 60 is thus contacted by the sintered layer 40, the web 60 starts receiving moisture from the sintered layer 40 at one of the web's sides. A pressure may be applied to facilitate moistening of the web 60 by the sintered layer 40.

In accordance with the preferred embodiment of the present invention, a temperature differential is created between the pressing surface 30 and the working surface 20. The temperature differential should be sufficient to cause the moisture added to at least the selected portions 62 of the web 60 to move through the selected portions 62 in the direction from one of the surfaces 30, 20 to the other 20, 30. Preferably, the temperature differential between the pressing surface 30 and the working surface 20 is provided by heating the pressing surface 30 to a temperature T1, and maintaining the supporting surface 24 at a temperature T2 sufficiently lower than T1. Thus, the temperature differential between the pressing surface 30 and the working surface 20 is preferably provided by creating the temperature differential between the pressing surface 30 and the supporting surface 24. In the drawings, the preferred arrangement is illustrated, in which the web's side which contacts the pressing surface 30 is first moistened, and the moisture is driven under the temperature differential from the pressing surface 30 to the working surface 20, and further through the expansion conduits 25 of the working surface 20 into the fabric 50. However, one skilled in the art should appreciate that the direction of the movement of the moisture through the web 60 could be reversed, provided the temperature of the working surface 20 is sufficiently greater relative to the temperature of the pressing surface 30. It should also be appreciated that, as used herein, the terms "pressing surface" and "working surface" are relative terms, and the expansion conduits may be provided in both or either one of the pressing surface 30 and the working surface 20. Consequently, the selected portions 62 of the web 60 can expand through the conduits of both or either one of the pressing surface 30 and working surface 20.

In the preferred embodiment, the pressing surface 30 is heated to have the temperature T1 higher than the temperature T2 of the supporting surface 24. In FIG. 4, the temperature differential ΔT between the pressing surface 20 and the supporting surface 24 causes the moisture contained in the sintered layer 40 move into and through the web 60 and towards the supporting surface 24. Because the surface-contacting portions 61 of the web 60 are sufficiently constrained between the pressing surface 30 and the working surface 20, the crepe in the surface-contacting portions 61 is not affected (or, if desired, affected to a lower degree) by the moisture driven through the web 60 from the pressing surface 30 towards the supporting surface 20. However, due to the existence of the expansion conduits 25 in the working surface 20, the selected areas 62, which correspond to the expansion conduits 25, are not constrained or constrained, if at all, only at one side associated with the pressing surface 30, as FIG. 5 shows. Therefore, the selected portions 62 are relatively free to expand towards the supporting surface 24. The preferred temperature differential ΔT between the pressing surface 30 and the supporting surface 24 is at least 50° F., and the more preferred temperature differential ΔT is at least 100° F. The temperature T2 of the "cool" surface (i.e., the supporting surface 24 in FIGS. 4, 5, and 8) is preferably less than 212° F.

FIG. 5A shows an embodiment in which the selected portions 62 are relatively unconstrained at both sides of the web 60, for in FIG. 5A the expansion conduits 25 of the working surface 20 correspond to the expansion conduits 35 of the pressing surface 30. It should also be understood that while FIG. 5A shows the embodiment in which the same selected portion 62 expands outwardly at both mutually opposite sides of the portion 62, the embodiment is possible (and may even be preferred) in which some of the selected portions 62 expand outwardly at one side of the web 60, while the other selected portions 62 expand at the other (opposite) side of the web 60. An embodiment is also possible in which the selected portions 62 partially expand outwardly at both mutually opposite sides of the web 60, as shown in FIG. 8, i.e., only part of the selected portion(s) 62 expands at both sides of the web 60. In FIG. 8, the conduits 35 of the pressing surface 30 partially correspond to the conduits 25 of the working surface 20.

Preferably, the selected portions 62 are free to expand through the expansion conduits 25 and 35. It is believed that the moisture moving through the selected portions 62 and through the expansion conduits 25 in the direction towards the supporting surface 24 facilitates expansion of the selected portions 62 through the expansion conduits 25, thereby relaxing the crepe in the selected portions 62 of the web 60. As the moistened selected portions 62 of the web 60 expand through the expansion conduits 25 and/or 35, the caliper of the selected portions 60 increases, thereby increasing the overall bulk of the web 60. In the finished web product (not shown), the selected portions 62 have a pattern which in plan view is essentially similar to the pattern of the working surface 20 including the expansion conduits 25 and/or 35. The preferred continuous and still foreshortened area comprising the surface-contacting portions 61 provides strength, while the discrete domes comprising crepe-relaxed selected portions 62 generate bulk, and thus are believed to improve softness and absorbency of the final web product. Additional densification of the surface-contacting portions 61 may provide further improvement of the finished web product's strength.

While not preferred, the steam moving under pressure through the web's selected portions 62 may be used in the present invention even without the use of the pressing surface 30 and the supporting surface 24, and without the assistance of the temperature differential ΔT between the pressing surface 30 and the supporting surface 24. One skilled in the art may easily visualize an embodiment (not shown) in which steam is forced to penetrate under pressure the selected portions 62 and move through the expansion conduits 25, thereby causing the crepe in the selected portions 62 to relax and the selected portions 62 to expand. In the latter embodiment, the steam preferably condenses into the fabric 50 and is recycled.

FIGS. 4 and 5 show preferred embodiments of the apparatus 10 of the present invention, comprising two opposite members: a pressing member 36 having the pressing surface 30, and a supporting member 26, having the supporting surface 24. In the preferred continuous process of the present invention, each of the pressing member 36 and the supporting member 26 comprises an endless belt or band traveling in the machine direction. In FIG. 5, the pressing member 36 comprises the sintered layer 40; and the supporting member 26 is associated with the moisture-receiving fabric 50, also comprising an endless belt. Preferably, the moisture which is driven through the selected portions 62 of the web 60 through the expansion conduits 25 of the working surface 20 condenses into the fabric 50 disposed between the working surface 20 and the supporting surface 24. Preferably, a means for collecting and recycling the moisture, well known in the art, is used in the process of the present invention.

As shown in FIGS. 2–5, the selected portions 62 of the web 60 correspond to the expansion conduits 25 of the working surface 20, and the surface-contacting portions 61 of the web 60 correspond to and are in contact with the working surface 20. In FIGS. 2–5, the surface-contacting portions 61 are constrained between the working surface 20 and the pressing surface 30. As has been explained above, the pressure should be sufficient to effectively constrain the portions 61 in the direction perpendicular to the working surface 20 so as to retain the crepe existing in the surface-contacting portions 61. However, if desired, the pressure may be applied in excess of that which is necessary to retain the crepe in the surface-contacting portions 61. In the latter instance, the surface-contacting portions 61 may be densified, while the selected portions 62, corresponding to the expansion conduits 25, are not densified, or—if desired—densified to a lesser degree than the surface-contacting portions 61 are. By densifying the foreshortened surface-contacting portions 61, one might achieve further improvement in the web's strength. One skilled in the art will appreciate that the degree of relative densification of the surface-contacting portions 61 and the selected portions 62 may depend upon the applied pressure and a relative geometry of the working surface 20 and the pressing surface 30. If desired, the selected portions 62 of the web 60 may also be constrained in the direction perpendicular to the working surface 20. For example, the selected portions 62 may be impressed between the pressing surface 30 and the fabric 50, as shown in FIG. 4. In the latter instance, both the surface-contacting portions 61 and the selected portions 62 of the web 60 may be densified, but to a different degree. The pressure differential between the pressure applied to the surface-contacting portions 61 and the pressure applied to the selected portions 62 may be controlled, on the one hand—by the distance between the pressing surface 30 and the corresponding working surface 20, and on the other hand—by the distance between the pressing surface 30 and a surface restricting the expansion of the portions 62, i.e., the surface of the reinforcing structure 23 in FIG. 3, or the surface of the fabric 50 in FIG. 4.

FIGS. 3 and 4 show two exemplary embodiments of the working surface 20 superimposed with the pressing surface 30. In FIG. 3, the pressing surface 30 comprises the projected areas 31. Some of the projected areas 31, i.e., the projected areas designated as 31*b*, correspond to (or registered with) the working surface 20. Other projected areas 31, i.e., the projected areas designated as 31*a*, correspond to (or registered with) the expansion conduits 25 of the working surface 20. While the embodiment of the working surface 20 shown in FIGS. 3 and 7 comprises discrete protuberances 27 encompassed by the continuous expansion conduit 25, it is to be understood that the projected areas of both the working surface 20 and the pressing surface 30 may (and preferably do) comprise the continuous network 22 described therein above and best shown in FIG. 6. (One skilled in the art will appreciate that the schematic side elevational view shown in FIG. 3 is equally applicable to the network 22 comprising both the continuous pattern shown in FIG. 6, and the discrete pattern shown in FIG. 7.)

It should be carefully noted that in FIG. 3, some of the projected areas 31, i.e., the projected areas 31*a*, of the pressing surface 30 have no corresponding protuberances 27 of the working surface 20, hence no corresponding working surface 20. Still, the selected portions 62 of the web 60 may be partially restrained between the projected areas 31*a* and the reinforcing structure 23. The selected portions 62 are constrained to a lesser degree relative to the selected portions 61. Because the projected areas 31*a* correspond to the expansion conduits 25 of the working surface 20, under the temperature differential $\Delta T$ the moisture travels from the projected areas 31*a* through the web 60, as has been described above. In the embodiment shown in FIG. 3, the pressure caused by the projected areas 31*a* partially impressing the selected portions 62 against the reinforcing structure 23 is less than the pressure caused by the projected areas 31*b* impressing the surface-contacting portions 61 against the working surface 20. Therefore, it is believed that in the embodiment schematically shown in FIG. 3 the selected portions 62 comprise sub-portions 62*a* which are relatively unrestrained in the direction perpendicular to the working surface 20, and sub-portions 62*b* which are restrained and may be partially impressed by the projected areas 31*a* corresponding to the expansion conduits 25 of the working surface 20. Without wishing to be limited by theory, Applicants believe that this principal arrangement of the working surface 20 and the pressing surface 30 may beneficially produce a web having at least three differential micro-regions: a first micro-region formed by the surface-contacting portions 61 constrained in the direction perpendicular to the working surface 20 and thus substantially retaining crepe therein; a second micro-region formed by the sub-portions 62*b* partially-constrained and partially expanding in the direction perpendicular to the working surface 20 and thus having the crepe partially relaxed therein; and a third micro-region formed by the sub-portions 62*a* relatively unconstrained in the direction perpendicular to the working surface 20 and having crepe substantially relaxed therein, the sub-portions 62*a* of the third micro-region expending in the direction perpendicular to the working surface 20.

In FIG. 4, showing another exemplary embodiment of the apparatus 10 of the present invention, the projected areas 31 of the pressing surface 30 are registered with the conduits 25 of the working surface 20 such that when the web 60 is constrained between the pressing surface 30 and the working surface 20, the projected areas 31 facilitate deflection of the selected portions 62 into the expansion conduits 25 of the working surface 20. In FIG. 4, the projected areas 31 of the pressing surface 30 correspond to the expansion conduits 25 of the working surface 20 and are in contact with the selected portions 62 of the web 60. When the web 60 is impressed, the projected areas 31 push, by contact, the selected portions 62 into the conduits 25, thereby causing the selected portions 62 to expand, as shown in FIG. 4.

While FIGS. 2–5 show the selected portions 62 of the web 60 expending substantially perpendicular to the working surface 20 and to the general plane of the web 60, "angled" expansion of the selected portions 62 is also contemplated by the present invention. Two commonly assigned patent applications, Ser. Nos. 08/858,662 and 08/858,661, both entitled "Cellulosic Web, Method and Apparatus for Making the Same Using Papermaking Belt Having Angled Cross-Sectional Structure, and Method of Making the Belt" are incorporated by reference herein. The former application discloses a papermaking belt comprising a continuous resinous framework joined to a reinforcing structure and having a plurality of discrete conduits therein, at least some of the conduits having an "angled" position relative to the plane of the belt, i.e., the axes of the conduits and the surface of the belt form acute angles therebetween. The latter application discloses the belt having a plurality of resinous protuberances joined to the reinforcing structure, and a continuous conduit, at least some of the protuberances being angled relative to the surface of the belt, i.e., the axes of the protuberances and the surface of the belt form acute angles therebetween. These embodiments are not illustrated herein, for in view of the two commonly-assigned patent application cited herein above one skilled in the art will be able to easily visualize the "angled" expansion of the selected portions 62 of the web 60.

The web 60, after having been subjected to the process of the present invention, may be re-foreshortened, if desired. As used herein, the term "re-foreshortening" refers to the process of foreshortening the web which has already been at least partially foreshortened. For example, the web 60, comprising the previously-foreshortened portions 61 and the expanded selected portions 62, may be adhered to a creping surface and then creped therefrom with a creping blade.

By way of illustration, and not by way of limitation, the following examples are presented. A conventionally-made, creped paper web, having basis weight of about 11 pounds per 3000 square feet, and the caliper of 6.0 mil, was crepe-relaxed according to the present invention and then tested. The following TABLE illustrates results of the testing.

TABLE

| Test | Pressure (psi) | Fiber-Consistency (%) | Resulting Caliper (mils) | Change in Caliper (%) |
|---|---|---|---|---|
| Base | N/A | about 95 | 6.0 | N/A |
| I | 55 | 20 | 8.9 | +48.3 |
| II | 55 | about 95 | 5.3 | −13.2 |
| III | 55 | 20 | 8.2 | +36.6 |
| IV | 55 | about 95 | 5.2 | −15.4 |

For comparison, a base sample of the dry web having caliper of 6.0 mils, which was not subjected to the process of the present invention, is shown in the first line of the Table.

Tests I and II were conducted using the apparatus 10 of the present invention, principally illustrated in FIG. 5. More specifically, this apparatus 10 comprises the working surface 20 formed by the surface of a 6"×6" platen 28 having a plurality of expansion conduits 25 therein, and the pressing surface 30 formed by the surface of the sintered layer 40. The conduits 25 are distributed throughout the working surface 20 in a staggered pattern such that the platen 28 has 40% open area (i.e., conduits 25 comprise 40% of the entire platen's surface). The platen 28 is made of a perforated metal, 14 gauge AL. Each of the conduits 25 is an aperture having 0.125" diameter. The sintered layer 40 is formed by a 6"×10"×0.078" Sintered Stainless Steel, having 40 $\mu$m pore size, made by Mott Corporation and referred to herein above. The platen 28 is adjacent to the condensation fabric 50 formed by 6"×6" portion of the Spiral Weave, Duraflex Belt, made by Albany International, Inc., which was referenced herein above.

Tests III and IV were conducted using the apparatus 10, schematically shown in FIG. 5A. This apparatus 10 comprises two mutually opposite 6"×6" platens 28, described in the previous paragraph. The platens 28 are interposed such that their respective conduits 25 and 35 correspond, as shown in FIG. 5A. The sintered layer 40 and the fabric 50 are identical to those described in the previous paragraph.

In all tests I–IV, a press (not shown) was used to cause the pressing member 36 and the supporting member 26 to move towards each other and to impress the working surface 20 with the associated web 60 therebetween. The press used is Carver Laboratory Press, Model "C," made by Carver, Inc., of Indiana (1569 Morris street, Wabash, Ind. 46992-0544). The press is equipped with 6"×6" Electric Heating Platens, Catalog No. 2101, available from Carver, Inc. In all I–IV tests, the web 60 was interposed between the working surface 20 and the pressing surface 30, the web 60 was at least partially moistened and impressed between the pressing and working surfaces 30, 20 at pressure of 55 psi (cylinder pressure) for 7 minutes. Then, the caliper of the selected portions of the dried web 60 (having fiber-consistency of about 95%) was measured.

In Test I, the entire sample of the web 60 was moistened to have fiber-consistency of about 20%. As TABLE shows, the caliper of the web 60 increased to 8.9 mils, i.e., by more than 48% relative to the base sample's caliper of 6.0 mils. For comparison, in Test II, a dry (about 95% fiber-consistency) sample of the web 60 was impressed under the same pressure; the resulting caliper was only 5.3 mils.

In Test III, only the selected portions 62, corresponding to the expansion conduits 25 and 35 were moistened to have fiber-consistency of about 20%. The resulting caliper of the selected portions 62 was 8.2 mils, i.e., increased by more than 36%, relative to the base sample's caliper of 6.0 mil. In Test IV, the dry (about 95% fiber-consistency) sample of the web, after having been impressed at the pressure of 55 psi, had 5.2 mils caliper.

Caliper of the selected portions 62 of web 60 was measured as the thickness of the "preconditioned" selected portions 62 when subjected to a compressive load of 15 gram per square centimeter (g/cm$^2$), or 95 gram per square inch (g/in$^2$), with a presser foot having diameter of 2 inches (5.08 cm). The term "preconditioned" means a web subjected to a temperature of (23±1)° C., and a relative humidity of (50±2)% for 24 hours, according to a TAPPI Method #T4020M-88. The caliper was measured with a Thwing-Albert model 89-11 thickness tester made by Thwing-Albert Co. of Philadelphia, Pa.

What is claimed is:

1. An apparatus for increasing bulk of a foreshortened web comprising crepe, the apparatus comprising:

a working surface designed to receive a foreshortened web thereon and having a plurality of fluid-permeable expansion conduits therethrough, wherein the plurality of expansion conduits comprises a substantially continuous orifice encompassing discrete areas comprising the working surface;

a means for disposing the foreshortened web on the working surface;

a means for adding moisture to at least selected portions of the foreshortened web, such that when the web is disposed on the working surface the selected portions of the web correspond to the expansion conduits of the working surface, and surface-contacting portions of the web correspond to the working surface; and a means for retaining the crepe in the surface-contacting portions of the web such that when the web is disposed on the working surface the moisture added to at least the selected portions causes the crepe in the selected portions to relax and the'selected portions to expand through the expansion conduits of the working surface, while the surface-contacting portions retain the crepe therein.

2. The apparatus according to claim 1, further comprising a pressing surface opposite to the working surface and structured to contact the foreshortened web disposed on the working surface.

3. The apparatus according to claim 2, wherein the pressing surface comprises projected areas.

4. The apparatus according to claim 3, wherein the projected areas of the pressing surface are registered with the expansion conduits of the working surface.

5. The apparatus according to claim 2, wherein the pressing surface has expansion conduits therethrough.

6. The apparatus according to claim 5, wherein the expansion conduits of the pressing surface are registered with the expansion conduits of the working surface.

7. The apparatus according to claim 2, further comprising a supporting surface associated with the working surface such that the working surface is disposed between the supporting surface and the pressing surface while facing the pressing surface; and a means for creating a temperature differential between the pressing surface and the supporting surface, the temperature differential being sufficient to cause the moisture added to the selected portions of the web to travel therethrough, thereby relaxing the crepe in the selected portions of the web.

8. The apparatus according to claim 7, wherein the temperature differential is at least 50° F.

9. The apparatus according to claim 7, wherein a temperature of one of the pressing surface and the supporting surface is less than 212° F.

10. The apparatus according to claim 9, wherein the temperature differential is at least 100° F.

11. The apparatus according to claim 7, wherein a temperature of the pressing surface is greater than a temperature of the supporting surface, the temperature differential causing the moisture added to at least the selected portions of the web to move in the direction from the pressing surface toward the supporting surface.

12. The apparatus according to claim 7, wherein each of the pressing surface, the working surface, and the supporting surface comprises an endless belt or band designed to continuously travel in a machine direction.

13. The apparatus according to claim 2, further comprising a means for continuously moving the pressing and working surfaces in a machine direction.

14. The apparatus according to claim 11, wherein the means for moistening at least the selected portions of the web comprises a sintered layer.

15. The apparatus according to claim 14, wherein the sintered layer comprises the pressing surface.

16. The apparatus according to claim 11, wherein the means for moistening at least the selected portions of the web comprises steam.

* * * * *